US005262009A

United States Patent [19]

Schiel et al.

[11] Patent Number: 5,262,009

[45] Date of Patent: Nov. 16, 1993

[54] STATIONARY SUPPORT DEVICE FOR DEWATERING WIRE

[75] Inventors: Christian Schiel, Heidenheim; Helmut Grimm, Ellwangen, both of Fed. Rep. of Germany

[73] Assignee: J. M. Voith GmbH, Fed. Rep. of Germany

[21] Appl. No.: 875,934

[22] Filed: Apr. 29, 1992

[30] Foreign Application Priority Data

Apr. 30, 1991 [DE] Fed. Rep. of Germany ... 9105328[U]

[51] Int. Cl.[5] ..... D21F 1/48; D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 3,140,225 | 7/1964 | Truxa | 162/352 |
| 3,201,308 | 8/1965 | Goddard | 162/352 |
| 3,520,775 | 7/1970 | Truxa | 162/352 |
| 3,647,620 | 3/1972 | Truxa | 162/352 |
| 4,865,692 | 12/1989 | Kade et al. | 162/352 |
| 5,129,992 | 7/1992 | Schiel et al. | 162/352 |
| 5,169,500 | 12/1992 | Majdell | 162/352 |

*Primary Examiner*—Karen M. Hastings

*Attorney, Agent, or Firm*—Ostrolenk, Faber, Gerb & Soffen

[57] ABSTRACT

A stationary support device for a paper making machine wire has a movable cover strip, which is formed of a movable support strip and a head strip formed of a hard material on the support strip. The head strip has a leading upstream edge over which the wire slides and has a dewatering surface after the leading edge and which forms a variable angle of inclination with the wire. In the region of its front edge the moveable support strip is connected by a web-groove joint to a rigid support. A bar which is displaceable cross machine is inserted in the rigid support on the rear of the support device. A plurality of obliquely extending grooves are provided in the bar. In each groove there is a slide block which receives the spherical head of a pin. The pin is engaged by its external thread in the internal thread of a square bushing which is fastened in the support strip of the cover strip. The position of the pin can be adjusted parallel to the direction of travel of the wire in the bushing.

21 Claims, 2 Drawing Sheets

STATIONARY SUPPORT DEVICE FOR DEWATERING WIRE

BACKGROUND OF THE INVENTION

The present invention relates to a stationary support device for the endless, revolving dewatering wire in the forming section or wire section of a machine for the manufacture of fiber webs of paper, board, pulp, or the like. Such stationary support devices are known from U.S. Pat. No. 3,647,620 over which the invention is an improvement. Similar devices are known from U.S. Pat. Nos. 3,140,225, 3,201,308 and 3,520,775. Note also U.S. Pat. Nos. 4,865,692 and 5,129,992. Stationary support devices of this type support the endless revolving screen, called a wire, on which the fiber web is initially formed from the fiber suspension which continuously flows onto the wire.

The wire slides over the front section of a cover strip located on top of a support. The front section usually has a scraper like front edge. The front section, and particularly its front edge, leads away from the wire water which has flowed through the openings in the wire out of the fiber web which is being formed and which water is then adhering to the bottom of the wire.

The cover strip has a dewatering surface which adjoins and follows the front section in the path of the movement of the wire and which diverges from the direction of travel of the wire at an angle of inclination. This produces a vacuum below the bottom of the revolving wire which improves the removal of the water from the web. The intensity of the water removal depends on the size of the angle of inclination of the dewatering surface relative to the travel direction of the wire.

In paper making machines in which operating conditions change frequently, for instance, upon changes of the type of paper, operating speed, or the like, it is frequently necessary to change the angle of inclination of the cover strip on the stationary support device. Attempts have for a long time been made to find a reliable construction for changing the angle of inclination.

U.S. Pat. No. 4,865,692 suggests making the angle of inclination, and therefore the angle between the dewatering surface and the direction of travel of the wire, reproducible with a high degree of accuracy. Furthermore, it has been attempted to make the stationary support device as free of vibration as possible. In order to achieve these goals, the joint between the cover strip and the support device in that patent is developed as a spring plate. Furthermore, the clamping element, which is developed as an expandable tube, acts such that the device is free of play. On the one hand, the joint is under tensile stress while, on the other hand, the support elements and the corresponding oblique surfaces are held continuously in mutual contact with each other. The oblique surface is formed by a wedge bar which transmits only compressive forces.

One disadvantage of that construction is that a joint which is developed as a spring plate does not form a definite joint axis. Accordingly, upon a change in the angle of inclination, the movement of the cover strip cannot be determined in advance with sufficient accuracy. Another disadvantage is that the moveable support strip and the rigid support are developed as two C-shaped supports which engage in each other. Thus, heavy parts of complicated shape are necessary, causing a relatively high cost of manufacture and a relatively large structural height.

In contrast, the construction known from U.S. Pat. No. 3,647,620 has simpler parts and a lower height. However, in that case also, the joint is developed as a spring plate, with the above indicated disadvantages. Furthermore, the bar which serves to position the cover strip i.e., for changing the angle of inclination, which is displaceable in lengthwise direction, is made of relatively thin flat material and has obliquely extending slots for the formation of the oblique surfaces. The support elements which cooperate with the oblique surfaces are developed as pins which extend through those slots. In this case, a certain amount of play is unavoidable between the pins and the cooperating oblique surfaces. Therefore, this known construction tends to vibrate. Furthermore, the angle of inclination of the dewatering surface cannot be established with the required high precision and reproducibility.

In this respect, relatively good results, with relatively low height, can be obtained with the arrangement in U.S. Pat. No. 5,129,992. However, that still has the disadvantage that, in order to make the joint and the pair of stop surfaces free of play, a relatively large number of parts are necessary within the device, and mounting those parts is expensive.

SUMMARY OF THE INVENTION

It is an object of the present invention to create a stationary support device which satisfies the following requirements:

1. The joint between the movable cover strip and the rigid support has a nonambiguously defined joint axis.
2. Simple means should make the contact locations between the parts of the device which are moveable with respect to each other free of play.
3. Both the structural height and the expense for parts should be kept as low as possible.

These objects are achieved by the invention. The invention proceeds from the construction in FIGS. 3 or 4 of U.S. Pat. No. 3,647,620. In that case although the joint is still developed as a spring plate, it is shaped so that it can transmit compressive forces from the movable cover strip to the rigid support in a direction parallel to the direction of travel of the wire.

The invention is based on the following discovery. If the support elements which cooperate with the oblique surfaces are adjustable approximately in the direction of travel of the wire and, if such adjustment brings them into contact with a counter support surface, this simply makes both the joint and the places of contact present between the support elements and the counter support surfaces free of play, or adjust them to a small degree of residual play which might be desired. This removal of play is effected by means of forces or adjustment movements having a direction which is approximately parallel to the direction of travel of the wire, rather than perpendicular to the direction of travel of the wire, as in the prior art. With the invention, only relatively few structural parts are necessary, and the required adjustment work can easily be effected from the outside.

The movable cover strip may consist of a single piece or be comprised of several pieces, as in the prior art. Preferably, a head strip comprised of hard material is fastened on a support strip. In all cases, however, the cover strip is itself rigid. In other words, in order to change the angle of inclination of the dewatering surface, the cover strip is always swung as a whole around the joint. (In a fundamentally different type of embodiment, the cover strip is deformed in order to change the angle of inclination of the dewatering surface).

Other features and advantages of the present invention will become apparent from the following description of the invention which refers to the accompanying drawings.

DETAILED DESCRIPTION OF THE INVENTION

Figure 1:
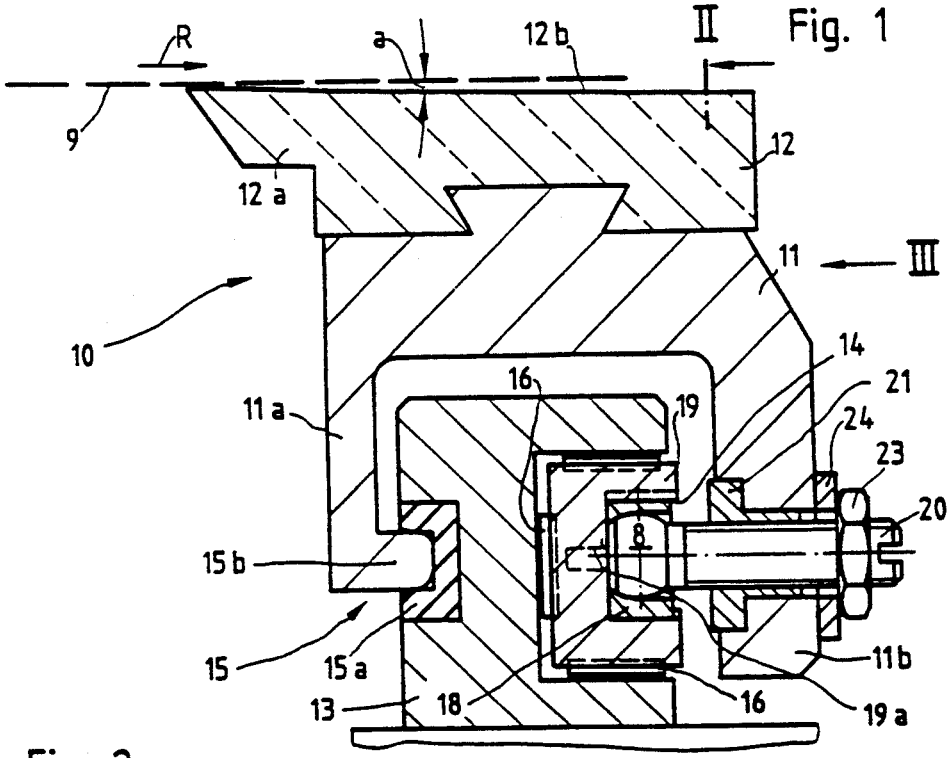
FIG. 1 shows a stationary support device in cross section.
Figure 2:
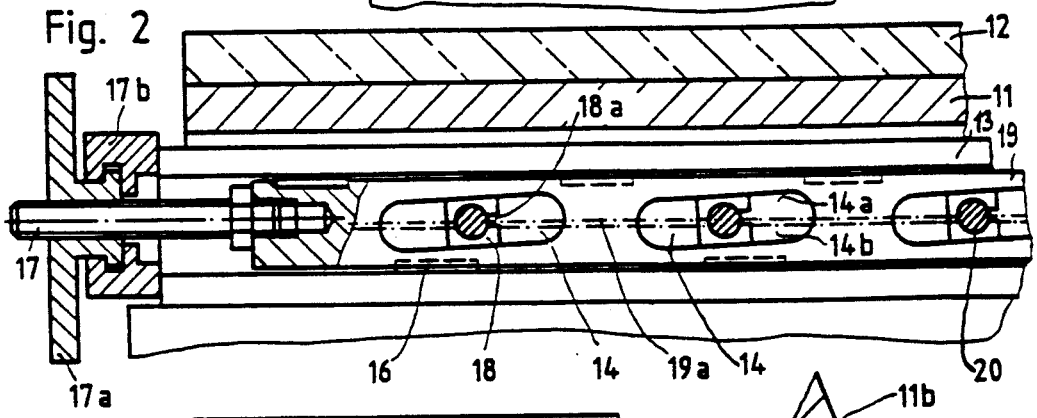
FIG. 2 is a vertical longitudinal section along the line II of FIG. 1.
Figure 3:
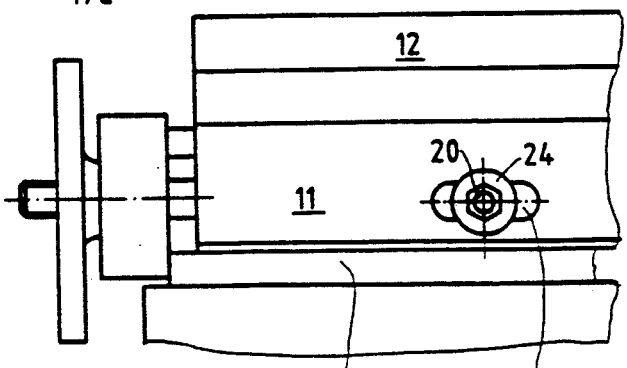
FIG. 3 is a view seen in the direction of the arrow III in FIG. 1.

The stationary support device embodiment shown in FIGS. 1 to 3 has a moveable cover strip 10, which extends transversely to the direction of travel arrow R of a paper making machine forming section wire 9. The cover strip 10 is comprised of a moveable support strip 11 and of a head strip 12 arranged on the support strip and formed of a hard material. The head strip 12 has a front, upstream or entrance section 12*a* with a scraper like front or leading edge which contacts the wire 9 and preferably the bottom of the wire to scrape off water. The head strip 12 also has a dewatering surface 12*b* adjoining and following downstream from the leading edge and which forms a small and variable angle of inclination a with the direction of travel R of the wire. In FIG. 1, the entire dewatering surface 12*b* lies in a single plane. However, deviation from this is also known. The direction of travel R of the wire 9 can be approximately horizontal, as shown. However, that direction may also be inclined or vertical. The installation position and orientation of the support 13 is adapted in each case to the direction of travel of the wire.

The support strip 11 of the cover strip 10 has an approximately U-shaped cross section. Between the downwardly extended arms 11*a*, 11*b* of the support strip 11, there is a rigid and stationary support 13. In a groove in the front or upstream side surface of the support 13, there is an inserted plastic material, profiled part 15*a* having a C-shape which defines a receptacle. That receptacle receives a short length web 15*b* that is formed at and bent off from the front or upstream arm 11*a* of the support strip 11 to extend parallel to the direction of wire travel. This defines a web-groove joint 15. As seen in cross section in FIG. 1, the web 15*b* extends approximately parallel to the direction of travel of the wire and extends into the groove of the C-shaped plastic part 15*a*. The parts are dimensioned so that the web 15*b* is seated without play in the direction transverse to the direction of travel of the wire, i.e. vertically in FIG. 1, in the plastic part 15*a*. The plastic part is comprised of a material which adapts itself to the slight displacements of the web 15*b*, which occur upon a change in the angle of inclination *a* by the elastic deformation of the plastic part. In a known manner, the joint 15 is always located below the front section 12*a* of the cover strip. The web 15*b* and the plastic part 15*a* extend continuously over the entire cross machine width of the stationary support device. They also form a seal which prevents the deposit of dirt within the support 13.

As an alternative to the construction shown in FIG. 1, a projecting web like 15*b* could be formed on the rigid support 13 while a corresponding groove, possibly with a plastic, web receiving insert, can be placed in the cover strip 10.

Figure 5:
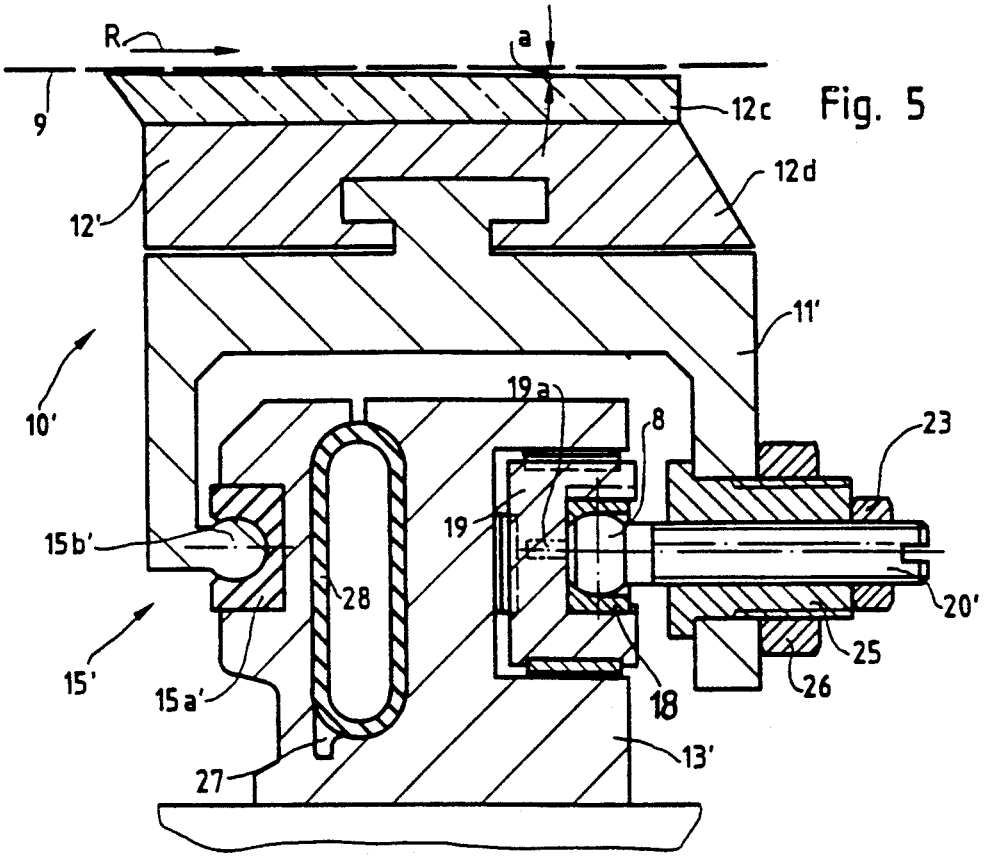
FIG. 5 is another embodiment differing from FIG. 1, and seen in cross section.

In the alternate embodiment of FIG. 5, the joint 15' is a roller joint. The web 15*b'* has a predominantly circular cylindrical head strip and the groove of the plastic part 15*a'* has a corresponding complementary circular cylindrical cross section. The plastic part 15*a* is sufficiently flexible that it can be installed onto the head strip of the web 15*b'* in the radial direction before the part 15*a* is inserted into the receiving opening in the rigid support 13. As can be seen in FIGS. 1 and 5, the pivot joint is not a spring plate.

Returning to FIGS. 1–3, in the rear or downstream side surface of the rigid support 13, there is another larger recess. A longitudinally displaceable bar 19 is disposed in that recess. The bar has a plurality of obliquely extending grooves 14 of rectangular cross section arranged in a row, one after the other, formed in its rearward surface. The top and bottom side surfaces of the grooves 14 are oblique surfaces. Slide tabs 16 are inserted into the gaps which are present in the bar groove between the bar 19 and the support 13. In each obliquely extending groove 14 there is a slide block 18 having a central frusto-spherical hole and an expansion slot 18*a* communciating into the hole.

A pin 20 is arranged in the rear or downstream arm 11*b* of the support strip 11 and serves as a support element. The pin 20 extends approximately parallel to the direction of travel of the wire. At its inner end, the pin has a frusto-spherical head 8 which engages into the correspondingly shaped frusto-spherical hole of the slide block 18. The pin 20 has an external thread which is engaged in the internal thread of a square head bushing 21. The bushing is seated in a horizontal slot 22 in the support strip 11, as shown in FIG. 3, and is fastened there together with the pin 20 by a nut 23 placed over a washer 24. Upon loosening of the nut 23, the position of the pin 20 can be adjusted in the direction of travel of the wire by turning the pin. In this way, the play, approximately parallel to the direction of travel R of the wire, in the joint 15 and also at the contact places between the pin 20 and the slide block 18, and between the slide block 18 and the bar 19, and between the bar 19 and the support 13 can be reduced or completely eliminated. The surfaces on which the parts abut each other are "countersupport surfaces". Differing from the drawing, the grooves 14 can have a trapezoidal cross section and the heads 8 of the pins 20 will have a shape adapted to the shapes of the grooves. In that case, the slide blocks 18 are not needed.

The slot 18*a* in the slide block lB enables it to be spread apart slightly by the spherical head 8 of the pin 20 so that the play between the slide block 18 and the bar 19 can be reduced or eliminated also transversely to the direction of travel of the wire. In addition, as indicated in dash-dot lines in FIGS. 1 and 2, if necessary, the bar 19 can be provided with a longitudinal slot 19*a* which connects the grooves 14 together. This enables the cross section of the bar 19 to be slightly spread in order to eliminate any play transverse to the direction of travel of the wire between the bar 19 and the support 13.

As long as the nuts 23 on the numerous pins 20 distributed over the length of the support device are loosened, the pins can also be adjusted along the longitudinal direction of the bar 19 by displacing the respective square bushing 21 in the respective slot 22. This enables the cover strip 10 to be adjusted in height over the width of the machine.

Figure 4:
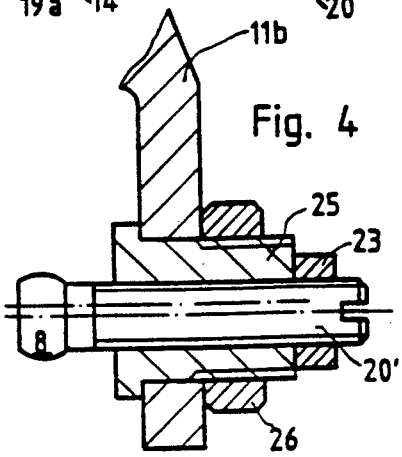
FIG. 4 is a cross section through an alternate embodiment of a detail which differs from FIG. 1.

The construction shown in FIGS. 1 to 3 can be modified as shown in FIG. 4. The slot and the square bushing seated therein on each individual pin 20' can be replaced with a sleeve 25 having an eccentric opening through it through which the pin 20' passes. The pin 20' can be fastened by a nut 26 on the rear or downstream arm **11*b'* of the support strip 11. Rotation of the sleeve 25 enables the cover strip 10** to be adjusted in height over the width of the machine.

FIG. 2 furthermore diagrammatically indicates that the longitudinal displacement of the bar 19 can be effected, for instance, by means of a threaded spindle 17 and a rotatable drive disk **17*a* which is axially fixed in a thrust bearing 17*b*. The drive disk 17*a*** can, if necessary, be turned by hand or by a motor (not shown). The motor can be controlled by an electric control device, for instance, so that displacement of the bar is brought about, for instance, automatically, as a result of certain measurement signals.

The embodiment shown in FIG. 5 differs in certain respects from the embodiment of FIGS. 1 to 3. The head strip 12' is comprised of an upper part **12*c* which is formed, for instance, of ceramic pieces and a lower part 12*d*. The lower part 12*d* has a T-shaped groove on its bottom side into which fits a T-shaped member formed on the support strip 11'. This enables the head strip 12' to be easily replaced, in case of possible damage, by a new one without it being necessary to again adjust the entire cover strip 10', particularly the support strip 11' plus the head strip 12'**, in height over the width of the machine.

As explained above, the joint 15' at the upstream side of the support is developed as a roller joint. The pin 20' with the frusto-spherical spherical head 8 is at the downstream side of the support. The position of the pin 20' is adjustable parallel to the direction of travel of the wire R by turning the pin. The pin 20' is seated, as in the embodiment of FIG. 4, in a sleeve 25 having an eccentric pin receiving opening through it.

In addition to the possibility of individually adjusting each individual pin 20', a recess 27 is provided in the support 13'. It extends over the entire length of the support. An expandable tube 28 is arranged in the recess 27. A pressure fluid can be fed to the inside of the tube 28 in order to spread the support 13', as seen in the cross section of FIG. 5. This can eliminate any play which may still be present simultaneously on all pins 20' distributed over the length of the support device. The pressure prevailing in the tube 28 can automatically be lowered a certain amount by a control device (not shown), while the bar 19 is displaced in order to change the angle of inclination a of the upper part **12*c* to the wire 9. Thereafter the pressure in the tube 28 can be increased again. In this way, the setting force necessary for the displacement of the bar 19 can be reduced. The tube 28 of FIG. 5 could be replaced for the same purpose by a similarly expandable tube between the plastic strip 15*a*, and the support 13'**.

Figure 6:
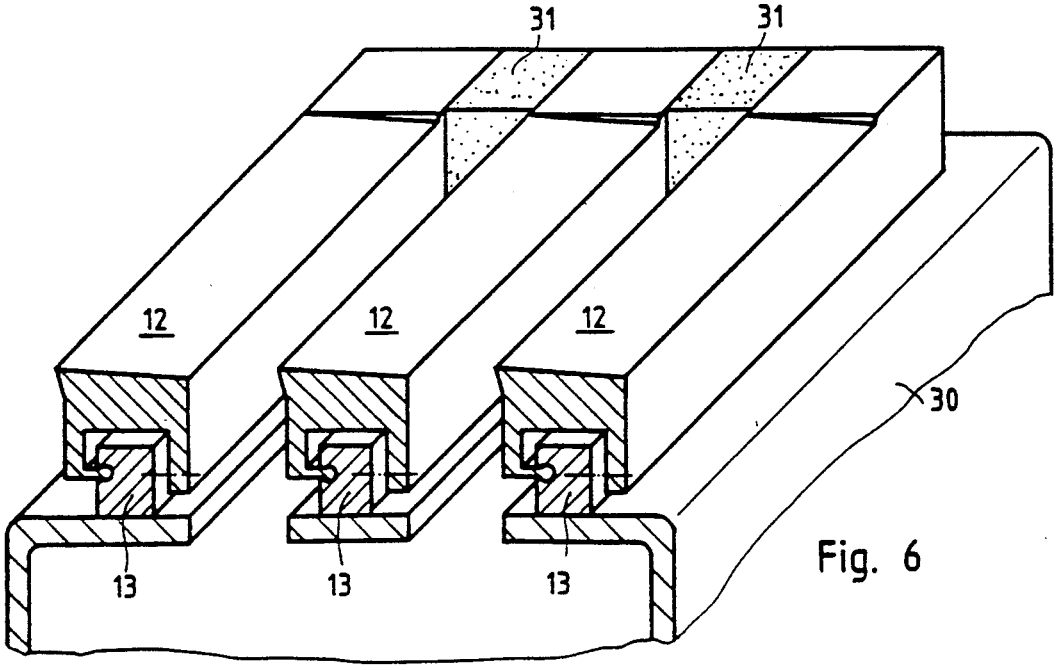
FIG. 6 is a partial view of a suction box having a plurality of stationary support devices.

FIG. 6 diagrammatically shows a known suction box 30 which would be located at the wire for suctioning water therefrom. The customary suction box top covering is replaced by three stationary support devices in accordance with the invention over which the wire travels. Water enters the suction box through the openings between adjacent support devices. The customary connections to the suction box for a vacuum line and a water discharge line are not shown. For laterally sealing the spaces present between neighboring cover strips 10, resilient fillers 31 are inserted between the ends of the moveable cover strips 12. The fillers for instance, are comprised of foam material.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A stationary support device for a dewatering wire of a machine for the manufacturing of a fiber web, the device comprising a fixed support extending transversely across the width of the wire;

a cover strip extending transversely across the width of the wire and extending over and coupled to the fixed support; the cover strip having a front section upstream in the direction of travel of the wire past the support device, and the front section being placed so that the wire slides over the front section; the cover strip having a dewatering surface adjoining the front section thereof and following the front section in the movement of the wire over the cover strip, the dewatering surface diverging from the direction of travel of the wire by an angle of inclination;

a joint between the fixed support and the cover strip, extending transversely across the width of the wire, the joint being arranged toward the upstream side of the fixed support, the joint being structured and shaped for transmitting pressure from the cover strip to the fixed support in a direction approximately parallel to the direction of travel of the wire past the cover strip and the joint being a pivot joint for permitting the cover to swing with respect to the fixed support at the joint in order to change the angle of inclination of the dewatering surface with respect to the wire, the pivot joint being without a sprint plate.

an adjusting device for adjusting the position and orientation of the cover strip with respect to the fixed support, the adjusting device being arranged toward the downstream side of the fixed support; the adjusting device comprising:

a bar extending transversely across the width of the wire, facing the downstream of the fixed support and extending generally parallel to the cover strip, the bar being supported for displacement along the longitudinal direction of the bar across the width of the wire, the bar being supported and guided in the fixed support;

a plurality of support element distributed across the width of the wire and movably coupling the cover strip to the bar, the support elements each extending substantially parallel to the travel direction of the wire;

means cooperating between the support elements and the bar for enabling relative movement of the support elements with respect to the bar and for adjusting the height of the support elements and the cover strip with respect to the bar;

means supporting each of the support elements for adjustment approximately in the direction of travel of the wire structured and arranged for absorbing play between the support elements and the bar in the direction of travel of the wire.

2. The stationary support device according to claim 1, wherein the means for adjusting the height of the support elements and the cover strip with respect to the bar comprises an oblique surface extending along the bar at each of the support elements, and the support elements being held to the cover strip and being movable along the respective oblique surfaces for moving the support elements vertically with respect to the bar which in turn moves the cover strip to which the support elements are attached vertically with respect to the bar.

3. The stationary support device according to claim 1, wherein the joint between the cover strip and the support is developed as a web in a groove joint with the web projecting in the direction of travel of the web and the groove opening in the opposite direction and receiving the web.

4. The stationary support device according to claim 3, wherein at least one of the elements of the web in groove joint is comprised of a plastics material.

5. The stationary support device according to claim 4, wherein the grooved element of the joint is a profiled plastic part having a generally C-shape and is located on the upstream facing side of the fixed support, the web being developed on the cover strip and extending into the groove in the fixed support, wherein the plastic part is deformable upon a change in the angle of inclination of the cover strip.

6. The stationary support device according to claim 1, wherein the joint comprises a roller joint including a groove defined on one of the cover strip and the fixed support, and the groove extending along the direction of travel of the wire, and a roller defined on the other of the cover strip and the fixed support and received in the groove, and the groove and the roller being shaped as to permit pivoting of the cover strip with respect to the support at the joint.

7. The stationary support device according to claim 2, further comprising grooves formed in the bar and extending along the length of the bar, which is across the width of the wire, and the oblique surfaces being formed by the grooves of the bar; the support elements being generally in the form of respective pins supported on the cover strip and extending into each of the grooves and moveable along the oblique surfaces of the grooves.

8. The stationary support device according to claim 7, further comprising a respective rotatable element in the cover strip through which each of the pins extends through the fixed support and each pin being eccentric of the respective rotatable element, such that rotation of the respective eccentric element eccentrically moves the pin to adjust the height thereof with reference to the fixed support.

9. The stationary support device according to claim 7, further comprising a horizontal slot in the cover strip through which each pin extends and the position of each pin is adjustable lengthwise of the bar and across the direction of the wire by movement of the pin through the respective horizontal slot in the cover strip.

10. The stationary support device according to claim 7, wherein each of the pins includes a head with spherically curved sides and the support bar has a respective slide block therein correspondingly shaped to the head of the respective pin in which the head of the pin is engaged.

11. The stationary support device according to claim 7, wherein the cover strip is generally U-shaped including arms which extend out past the upstream and downstream sides of the fixed support far enough to at least in part laterally cover the fixed support and the bar.

12. The stationary support device according to claim 1, wherein each of the support elements is respectively individually adjustable along a direction substantially parallel to the direction of the travel of the wire for absorbing play.

13. The stationary support device according to claim 1, wherein all of the supporting elements are adjustable jointly and relatively to the fixed support and the bar in a direction substantially parallel to the direction of travel of the wire.

14. The stationary support device according to claim 7, further comprising means at the fixed support for adjusting the distance between the joint toward the upstream side of the fixed support and the bar toward the downstream side of the fixed support.

15. The stationary support device according to claim 8, wherein the adjusting means at the fixed support comprises an inflatable tube in the support inflatable for expanding support between the joint and the bar.

16. The stationary support device according to claim 1, wherein the cover strip is generally U-shaped including arms which extend past the upstream and downstream sides of the fixed support far enough to at least in part laterally cover the fixed support and the bar.

17. A suction box for a machine for the manufacture of a fiber web, the section box having a cover thereon and the cover comprising a plurality of the stationary support devices of claim 1, each extending across the cover.

18. A stationary support device for a dewatering wire of a machine for the manufacturing of a fiber web, the device comprising a fixed support extending transversely across the width of the wire;

a cover strip extending transversely across the width of the wire and extending over and coupled to the fixed support; the cover strip having a front section upstream in the direction of travel of the wire past the support device, and the front section being placed so that the wire slides over the front section; the cover strip having a dewatering surface adjoining the front section thereof and following the front section in the movement of the wire over the cover strip, the dewatering surface diverging from the direction of travel of the wire by an angle of inclination;

a joint between the fixed support and the cover strip, extending transversely across the width of the wire, the joint being arranged toward the upstream side of the fixed support, the joint being structured and shaped for transmitting pressure from the cover strip to the fixed support in a direction approximately parallel to the direction of travel of the wire past the cover strip and the joint being a pivot joint for permitting the cover to swing with respect to the fixed support at the joint in order to change the angle of inclination of the dewatering surface with respect to the wire;

an adjusting device for adjusting the position and orientation of the cover strip with respect to the fixed support, the adjusting device being arranged toward the downstream side of the fixed support, the adjusting device comprising:

a bar extending transversely across the width of the wire, facing the downstream side of the fixed support and extending generally parallel to the cover strip, the bar being supported for displacement along the longitudinal direction of the bar across the width of the wire;

a plurality of support elements distributed across the width of the wire and movably coupling the cover strip to the bar, the support elements each extending substantially parallel to the travel direction of the wire;

means cooperating between the support elements and the bar for enabling relative movement of the support elements with respect to the bar and for adjusting the height of the support elements and the cover strip with respect to the bar;

means supporting each of the support elements for adjustment approximately in the direction of travel of the wire structured and arranged for absorbing play between the support elements and the bar in the direction of travel of the wire;

said means for adjusting the height of the support elements and the cover strip with respect to the bar comprising an oblique surface extending along the bar at each of the support elements, and the support elements being held to the cover strip and being movable along the respective oblique surfaces for moving the support elements vertically with respect to the bar which in turn moves the cover strip to which the support elements are attached vertically with respect to the bar;

grooves formed in the bar and extending along the length of the wire, which is across the width of the wire, and the oblique surfaces being formed by the grooves of the bar; the support elements being generally in the form of respective pins supported on the cover strip and extending into each of the grooves and movable along the oblique surfaces of the grooves;

each of said pins including a head with spherically curved sides and said support bar having respective slide block therein correspondingly shaped to the head of the respective pin in which the head of the pin is engaged; and each of said grooves having opposite spaced apart oblique surfaces that define the groove, the slide block being in the groove in the bar between the oblique surfaces, and the slide block being shaped for being spreadable to be applied without play against the oblique surfaces of the bar.

19. The stationary support device according to claim 18, wherein each of the pins has a frusto-spherical head in the slide block.

20. A stationary support device for a dewatering wire of a machine for the manufacturing of a fiber web, the device comprising a fixed support extending transversely across the width of the wire;

a cover strip extending transversely across the width of the wire and extending over and coupled to the fixed support; the cover strip having a front section upstream in the direction of travel of the wire past the support device, and the front section being placed so that the wire slides over the front section; the cover strip having a dewatering surface adjoining the front section thereof and following the front section in the movement of the wire over the cover strip, the dewatering surface diverging from the direction of travel of the wire by an angle of inclination;

a joint between the fixed support and the cover strip, extending transversely across the width of the wire, the joint being arranged toward the upstream side of the fixed support, the joint being structured and shaped for transmitting pressure from the cover strip to the fixed support in a direction approximately parallel to the direction of travel of the wire past the cover strip and the joint being a pivot joint for permitting the cover to swing with respect to the fixed support at the joint in order to change the angle of inclination of the dewatering surface with respect to the wire;

an adjusting device for adjusting the position and orientation of the cover strip with respect to the fixed support, the adjusting device being arranged toward the downstream side of the fixed support; the adjusting device comprising:

a bar extending transversely across the width of the wire, facing the downstream side of the fixed support and extending generally parallel to the cover strip, the bar being supported for displacement along the longitudinal direction of the bar across the width of the wire;

a plurality of support elements distributed across the width of the wire and movably coupling the cover strip to the bar, the support elements each extending substantially parallel to the travel direction of the wire;

means cooperating between the support elements and the bar for enabling relative movement of the support elements with respect to the bar and for adjusting the height of the support elements and the cover strip with respect to the bar;

means supporting each of the support elements for adjustment approximately in the direction of travel of the wire structured and arranged for absorbing play between the support elements and the bar in the direction of travel of the wire;

said bar being supported and guided in the fixed support; and said fixed support having a support having a support groove in which the bar is supported and the support groove having slide surfaces against which the bar may be disposed, said bar including means enabling the bar to be spread for being applied without play against the slide surfaces in the support groove.

21. The stationary support device according to claim 16, further comprising grooves formed in the bar and extending along the length of the bar, which is across the width of the wire, and the oblique surfaces being formed by the grooves of the bar; the support elements being generally in the form of respective pins supported on the cover strip and extending into each of the grooves and movable along the oblique surfaces of the grooves;

the means enabling the bar to be spread comprises a longitudinal slot along the bar and connecting the grooves in the bar and the bar being spreadable at the longitudinal slot.

* * * * *